US012150616B2

(12) United States Patent
Caruso

(10) Patent No.: US 12,150,616 B2
(45) Date of Patent: Nov. 26, 2024

(54) ENHANCED EDGE CLEANING STRUCTURES AND DEVICES WITH, SELECTABLE, MECHANICAL AND/OR ELECTRO-MECHANICALY ACTUATED AND/OR SENSOR OR MAP ACTIVATED AIR-FLOW AND DEBRIS APERATURES/DOORS/DEBRIS APERATURES

(71) Applicant: Steven Jerome Caruso, Antioch, IL (US)

(72) Inventor: Steven Jerome Caruso, Antioch, IL (US)

( * ) Notice: Subject to any disclaimer, the term of this patent is extended or adjusted under 35 U.S.C. 154(b) by 51 days.

(21) Appl. No.: 17/393,055

(22) Filed: Aug. 3, 2021

(65) Prior Publication Data

US 2022/0095865 A1 Mar. 31, 2022

Related U.S. Application Data

(60) Provisional application No. 63/140,216, filed on Jan. 21, 2021, provisional application No. 63/085,702, filed on Sep. 30, 2020, provisional application No. 63/061,116, filed on Aug. 4, 2020, provisional application No. 63/061,119, filed on Aug. 4, 2020.

(51) Int. Cl.
*A47L 9/04* (2006.01)
*A47L 5/26* (2006.01)

(52) U.S. Cl.
CPC ..... *A47L 9/0488* (2013.01); *A47L 5/26* (2013.01); *A47L 9/0477* (2013.01); *A47L 9/0433* (2013.01)

(58) Field of Classification Search
CPC .... A47L 9/0488; A47L 9/0477; A47L 9/0433; A47L 9/02; A47L 5/26; A47L 5/36
See application file for complete search history.

(56) References Cited

U.S. PATENT DOCUMENTS

| | | | | | |
|---|---|---|---|---|---|
| 2,348,861 | A * | 5/1944 | Smellie | A47L 9/0653 | 15/364 |
| 3,942,219 | A * | 3/1976 | Johnson | A47L 9/04 | 15/416 |
| 4,023,234 | A * | 5/1977 | Martinec | A47L 5/30 | 15/331 |
| 4,447,930 | A * | 5/1984 | Glenn, III | A47L 11/34 | 15/325 |
| 4,499,628 | A * | 2/1985 | Platt | A47L 9/02 | 15/419 |
| 5,475,893 | A * | 12/1995 | Sepke | A47L 9/066 | 15/364 |
| 6,039,817 | A * | 3/2000 | Payne | A47L 9/02 | 134/21 |
| 6,514,356 | B2 * | 2/2003 | Vystrcil | A47L 9/062 | 15/373 |
| 8,752,240 | B2 * | 6/2014 | Pruiett | A47L 9/2889 | 15/319 |
| 9,044,128 | B1 * | 6/2015 | Thomas | A47L 5/28 | |
| 2013/0092190 | A1 * | 4/2013 | Yoon | G05D 1/0242 | 15/21.1 |
| 2019/0090704 | A1 * | 3/2019 | Bosses | A47L 5/30 | |

* cited by examiner

*Primary Examiner* — Eric J Rosen
*Assistant Examiner* — Christopher Soto

(57) ABSTRACT

New and novel structure(s) for cleaning surfaces have been disclosed. The structures, configurations and methods disclosed herein are new to this world and functionally and structurally enable that which was not possible previously. The invention at hand uniquely and inventively improves upon the known devices in this field.

18 Claims, 10 Drawing Sheets

TRIMETRIC

SIDE

TOP

FRONT

TRIMETRIC

SIDE

TOP

FRONT

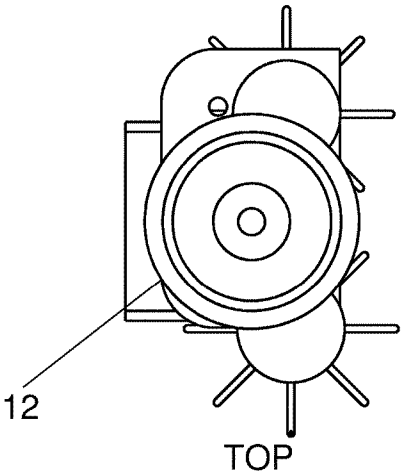
FIGURE19
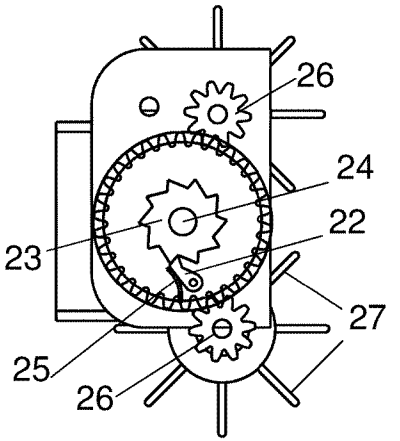
TOP WHEEL REMOVED
FIGURE 20
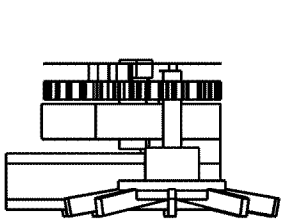
FRONT
FIGURE21
FRONT WHEEL REMOVED
FIGURE 22

TRIMETRIC

TRIMETRIC WHEEL REMOVED

SIDE

SIDE WHEEL REMOVED

TRIMETRIC

SIDE

TOP

7

FRONT

ENHANCED EDGE CLEANING STRUCTURES AND DEVICES WITH, SELECTABLE, MECHANICAL AND/OR ELECTRO-MECHANICALY ACTUATED AND/OR SENSOR OR MAP ACTIVATED AIR-FLOW AND DEBRIS APERATURES/DOORS/DEBRIS APERATURES

RELATED APPLICATIONS

This application claims the benefit of U.S. provisional application 63/061,116 filed Aug. 4, 2020 and U.S. provisional application 63/061,119 also filed Aug. 4, 2020 and U.S. provisional application 63/085,702 filed Sep. 30, 2020 and U.S. provisional application 63/140,216 filed Jan. 21, 2021 all of which are incorporated by this reference in their entirety. The entire disclosure of the above, and each application referred to in this paragraph of listed patent applications and their entire prosecution history to date is/are hereby incorporated herein by reference in its/their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates generally to devices for cleaning surfaces.

In the art of devices for cleaning surfaces, there exists a multitude of appliances and functions that must be served. There are vacuums that are to be used on floors and they are expected to clean up to walls, baseboards and the like. However, there are shortcomings to present solutions with regard to efficacy, particulate size pickup abilities, and existing configurations that inhibit or reduce the efficacy of the cleaning device when not cleaning against a wall, baseboard, chair leg or the like. The invention at hand seeks to inventively improve by providing new and novel devices, structures and methods for both vacuums and non-suction based sweepers as well as other end effectors such as powered and un-powered upholstery brushes/nozzles and the like.

BRIEF SUMMARY OF THE INVENTION

The present invention is a new and novel structure(s) and formats of structures for cleaning surfaces right up to obstacles such as walls furniture, baseboards and the like.

In the art of devices for cleaning surfaces, there exists a multitude of appliances and functions that must be served. There are vacuums that are to be used on floors and they are expected to clean up to walls, baseboards and the like. However, there are shortcomings to present solutions with regard to efficacy, particulate size pickup abilities, and existing configurations that inhibit or reduce the efficacy of the cleaning device when not cleaning against a wall, baseboard, chair leg or the like. The invention at hand seeks to inventively improve by providing new and novel devices, structures and methods for both vacuums and non-suction based sweepers. Included are applications that involve robotic vacuums and where the invention(s) would be deployed therewith.

Known configurations for this type of cleaning with a floor foot, brush rolled or not, are to create air channels that extend from the main suction inlet to an edge or edges. The problems with this is that in order to not reduce the suction from the main area too dramatically these channels must be kept rather small an thus cannot pick up large debris. At the same time, these channels are always "bleeding" from the system even when not needed, i.e. not against another surface, and causing the main intake area to not have maximum airflow when the user is vacuuming/sweeping mid areas.

As such, the invention discloses new and novel ways of enhanced debris removal from problem zones/situations, while also enhancing performance when the user and vacuum/sweeper is not in those problem zones/situations.

BRIEF DESCRIPTION OF SEVERAL VIEWS OF THE DRAWINGS

FIG. 1 and two are to give an overview of the multitude of types of vacuums and sweepers that the invention may be deployed within.

FIGS. 3-7*b* can also be interpreted to be illustrative of a generally self-contained robotic vacuum. These units can range from rectilinear shapes to "D" shapes as depicted to generally round puck like shapes. Never the less, all shapes fit within the spirit and scope of the invention(s) and claims.

And FIGS. 19-26 are views of various embodiments of the mechanical subassembly area of detail AREA "A" concerning the mechanical powering of brushes.

The embodiments devices and structures of FIGS. 11-18 and of FIGS. 19-26 may used alone on a device or structurally be combined in a stacked relationship, side by side relationship or distal to each other on the same device.

Figure 13:
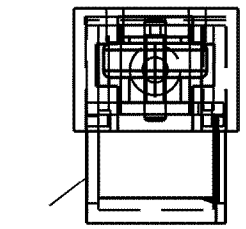
Figure 11:
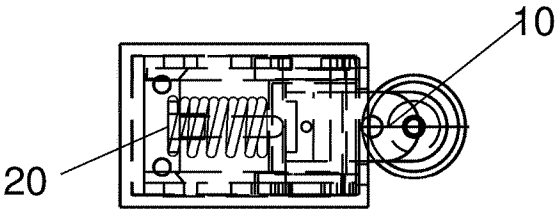
Figure 12:
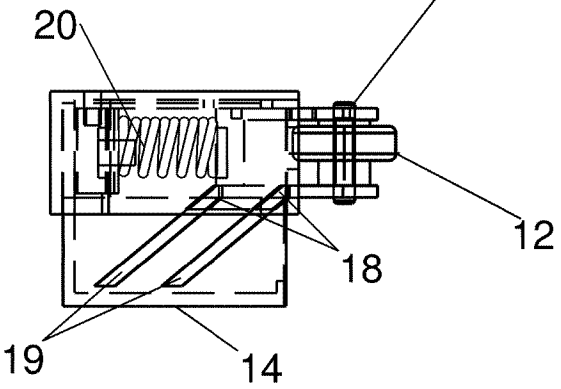

FIG. 11 is a top view of the embodiments of FIGS. 11 to 13.

FIG. 12 is a front view of the embodiments of FIGS. 11 to 13.

FIG. 13 is a side view of the embodiments of FIGS. 11 to 13.

Figure 14:
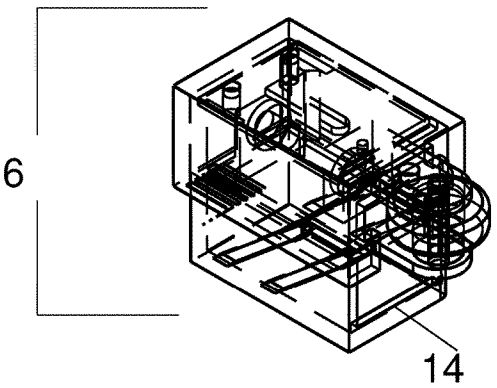
FIG. 11-18 are views of various embodiments of the mechanical subassembly area of detail AREA "A" concerning the opening door/aperture aspect/embodiments.

FIG. 14 is a trimetric view of the embodiments of FIGS. 11 to 13.

Figure 15:
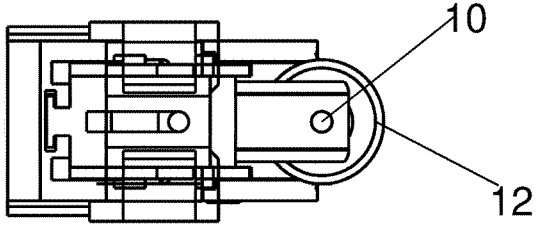

FIG. 15 is a top view of the embodiments of FIGS. 15 to 18.

Figure 16:
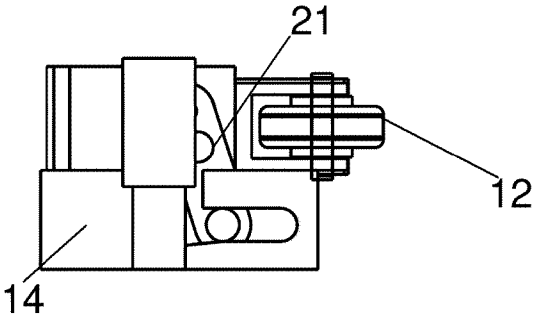

FIG. 16 is a front view of the embodiments of FIGS. 15 to 18.

Figure 17:
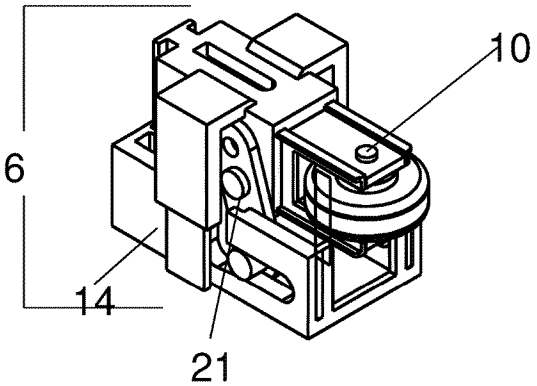

FIG. 17 is a side view of the embodiments of FIGS. 15 to 18.

Figure 18:
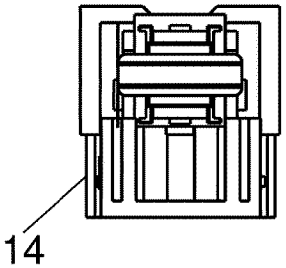

FIG. 18 is a trimetric view of the embodiments of FIGS. 15 to 18.

FIGS. 19-26 are views of various embodiments of the mechanical subassembly area of detail AREA "A" concerning the mechanical powering of brushes.

The embodiments devices and structures of FIGS. 11-18 and of FIGS. 19-26 may used alone on a device or structurally be combined in a stacked relationship, side by side relationship or distal to each other on the same device.

FIG. 19 is a top view of the embodiments of FIGS. 19 to 26 showing the friction wheel on the device.

FIG. 20 is a top view of the embodiments of FIGS. 19 to 26 showing the friction wheel off the device.

FIG. 21 is a front view of the embodiments of FIGS. 19 to 26 showing the friction wheel on the device.

FIG. 22 is a front view of the embodiments of FIGS. 19 to 26 showing the friction wheel off the device.

Figure 23:
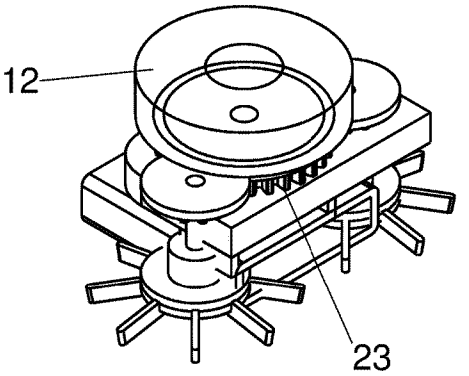

FIG. 23 is a trimetric view of the embodiments of FIGS. 19 to 26 showing the friction wheel on the device.

Figure 24:
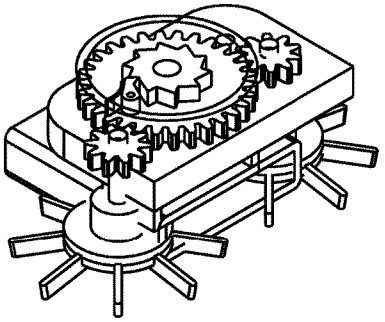

FIG. 24 is a trimetric view of the embodiments of FIGS. 19 to 26 showing the friction wheel off the device.

Figure 25:
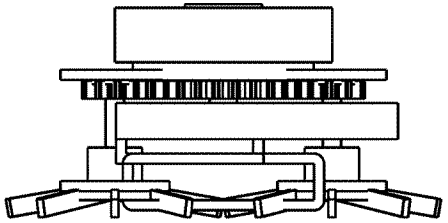

FIG. 25 is a side view of the embodiments of FIGS. 19 to 26 showing the friction wheel on the device.

Figure 26:
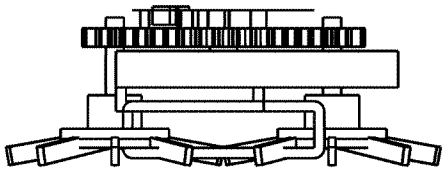

FIG. 26 is a side view of the embodiments of FIGS. 19 to 26 showing the friction wheel off the device.

Figure 27:
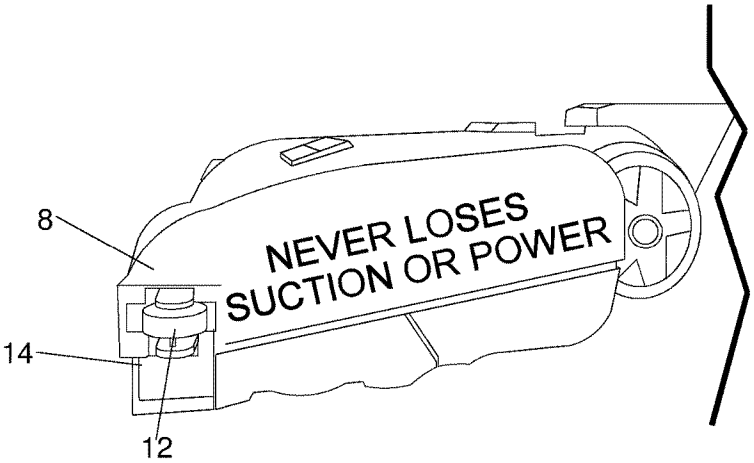

FIG. 27 is a side view similar to FIGS. 3-10 showing a close up of the invention disposed generally on a corner of a cleaning foot/head/robot and in front of a brushroll if one is included.

Figure 28:
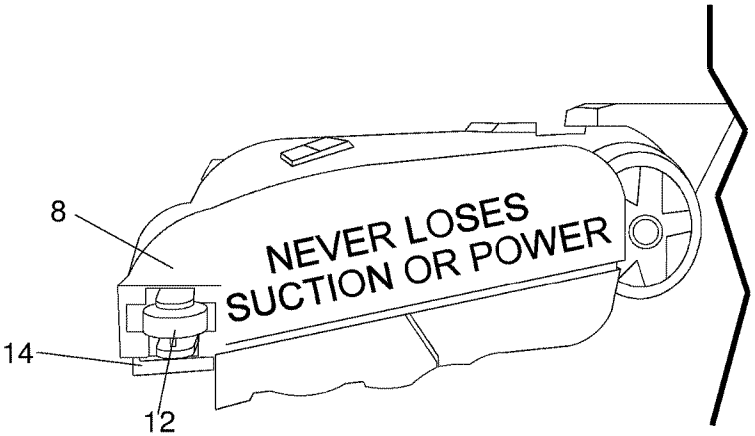

FIG. 28 is a side view similar to that of FIG. 28 but showing the doored or entry point in a raised position.

Figure 29:
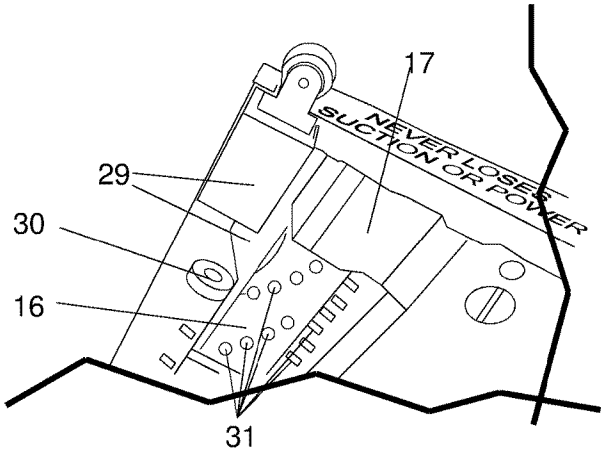

FIG. 29 is a bottom anaxometric similar to that of FIGS. 28 and 29 but showing the doored or entry point and then entry channel and brushroll and their relative structural dispositions in greater detail. These figures apply equally to embodiments that are mechanical in nature as well as those that are electro-mechanical in nature.

Figure 30:
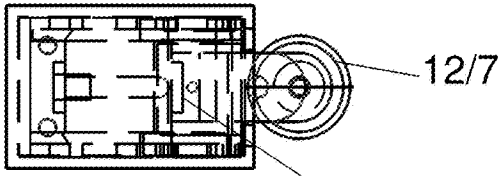

FIG. 30 is a top view of the embodiments of FIGS. 30 through 33 showing an electrical solenoid actuator structure with a spring return. A servo or other electromechanical actuator is anticipated. The embodiments devices and structures of FIGS. 30-33 and of FIGS. 19-26 may used alone on a device or structurally be combined in a stacked relationship, side by side relationship or distal to each other on the same device.

Figure 31:
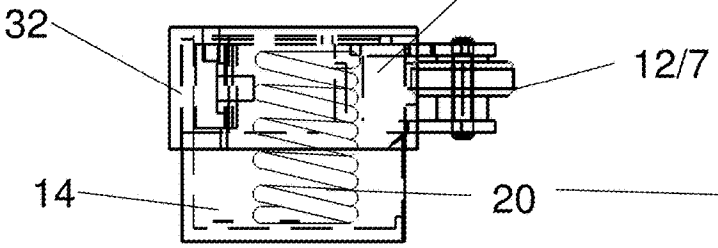

FIG. 31 is a front view of the embodiments of FIGS. 30 through 33.

Figure 32:
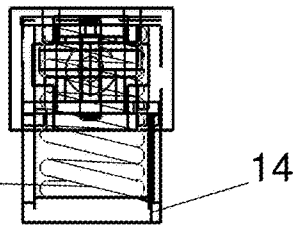

FIG. 32 is a side view of the embodiments of FIGS. 30 through 33.

Figure 33:
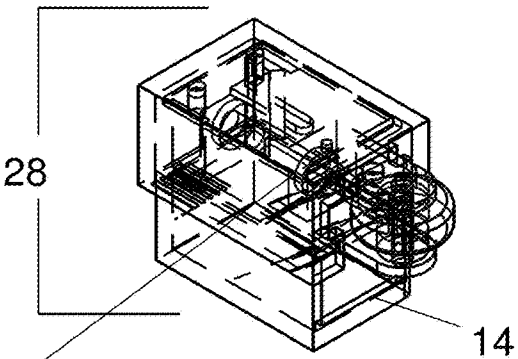

FIG. 33 is a trimetric view of the embodiments of FIGS. 30 through 33.

REFERENCE CHARACTERS USED

The following reference characters are used in the drawings of refer to the parts of the present invention. Like reference characters indicate like or corresponding parts in the respective views.

1—handle upright—has electrical running its length in some embodiments
2—Flex hose—may also be extendable in some embodiments
3—Shuttle handle—has electrical in some embodiments
4—Main vacuum unit Motor/Impeller/dust cup-dust bag/batteries in some embodiments/
5—Vacuum handle
6—Mechanical actuator
7—Switch(es)/sensors
8—Vacuum Foot
9—Interconnect Cuff
10—Mechanical actuator input
12—Wheel
13—Electro-Mechanical actuator input
14—Door or movable/openable aperature/breach
15—Front visor
16—Brushroll
17—Brushroll drive end
18—Wedge lug(s) of 10/13
19—Wedge groove(s) of 14, —Door or movable
20—Spring
21—Link
22—Pawl
23—Ratchet and Large spur gear assembly
24—Central shaft
25—Leaf spring
26—Spur Gear driving brushes
27—Brushes
28—Electromechanical subassembly
29—Inlet channel
30—Front guide wheel
31—Brush Tufts
32—Affixed to main unit

DETAILED DESCRIPTION OF THE INVENTION

While the invention will be described in connection with several preferred embodiments, it will be understood that the invention is not limited to these embodiments. On the contrary, the invention includes all alternatives, modifications, combinations, and equivalents as may be included within the spirit and scope of the appended claims.

In the art of devices for cleaning surfaces, there exists a multitude of appliances and functions that must be served. There are vacuums that are to be used on floors and they are expected to clean up to walls, baseboards and the like. However, there are shortcomings to present solutions with regard to efficacy, particulate size pickup abilities, and existing configurations that inhibit or reduce the efficacy of the cleaning device when not cleaning against a wall, baseboard, chair leg or the like. Known configurations for this type of cleaning with a floor foot, brushrolled or not, are to create air channels that extend from the main suction inlet to an edge or edges. The problems with this is that in order to not reduce the suction from the main area too dramatically these channels must be kept rather small an thus cannot pick up large debris. At the same time, these channels are always "bleeding" from the system even when not needed, i.e. not against another surface, and causing the main intake area to not have maximum airflow when the user is vacuuming/sweeping mid areas. Advantageous deployment of the invention at hand in robotic vacuums is anticipated. These vacuums usually have very small brush-roll/vacuum channels as they have limited power, so they need to conserve what power they do have by minimizing fan size-thus air flow and/brush size. This makes this invention additionally ideal for these integrations.

The invention at hand seeks to inventively improve by providing new and novel devices, structures and methods for both vacuums and non-suction based sweepers.

And so the present invention is a new and novel structure(s) and formats of structures for cleaning surfaces right up to obstacles such as walls furniture, baseboards and the like.

As such, the invention discloses new and novel ways of enhanced debris removal from problem zones/situations, also enhancing performance when the user and vacuum/sweeper is not in those problem zones/situations. Included are applications that involve robotic vacuums and where the invention(s) would be deployed therewith.

REFERRING TO THE FIGURES

Referring to all the Figures:

While some figures and descriptions may or may not be viewed as more directed at purely mechanical embodiments, and others may or may not be viewed as more directed at electromechanical embodiments, all structural enablements, all figures and all descriptions are to be viewed as interchangeable within the spirit and scope of the disclosed invention(s).

Referring to all the Figures:

Vacuum "feet" and/or vacuuming robots come in a variety of shapes and sizes. Collectively within this disclosure the term box or box like may be used. As a box is a catchall for a form with sides (sidewalls) contents (mechanical and electromechanical cleaning elements, wheels fans etc.) and a box can come in many shapes from square to rectilinear to oval and round (such as hat boxes) Sometimes these shapes are referred to as "box shaped foot" or "D shaped foot" or "square" or "rectilinear" foot/feet/end effectors or "round robots" or "D shaped robots" or "square" or "rectilinear" robots. All of these and any other descriptors of peripheral shape or overall form are anticipated, interchangeable, and incorporated within this disclosure.

Also of note is that some figures illustrate a wall or visor being moved in one structural fashion or another (sliding/pivoting/raising) and others show a block like structure or block/blocking element(s) that serve to further control and block the leakage of air and further enable larger breaches when desired. All of these structures and terms may be used interchangeably within the disclosure and claims without restriction.

Figure 1:
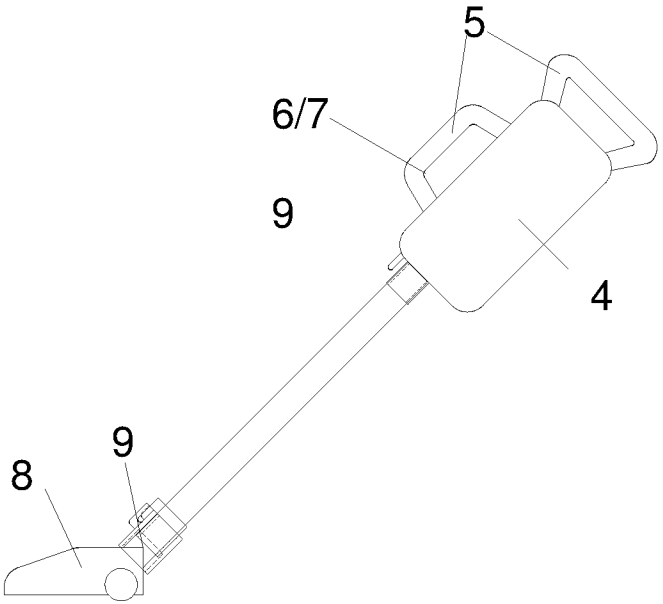
FIG. 1—Is a side view of one configuration of an exemplary vacuum which is generally representing an upright or stick vacuum.

Referring to FIG. 1, FIG. 1 Is a side view of one configuration of an exemplary vacuum which is generally representing an upright or stick vacuum.

Figure 2:
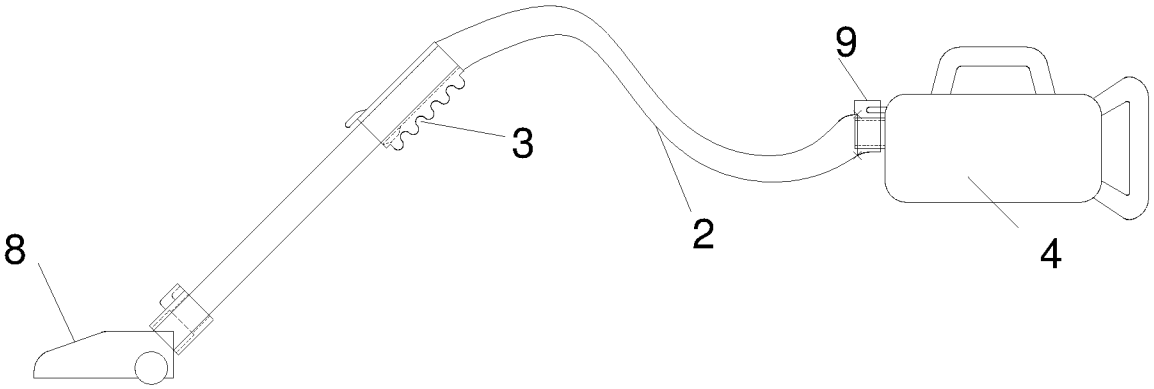
FIG. 2—Is a side view of one configuration of an exemplary vacuum cleaner which is generally representing a canister vacuum.

FIG. 2—Is a side view of one configuration of an exemplary vacuum cleaner which is generally representing a canister vacuum. FIG. 1 and two are to give an overview of the multitude of types of vacuums and sweepers that the invention may be deployed within.

Figure 3:
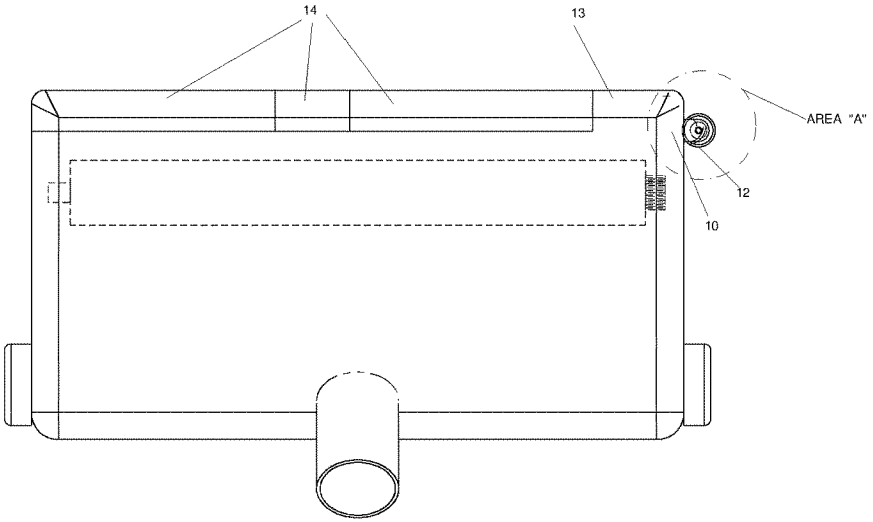
FIG. 3—is a top view of a foot of a vacuum cleaner employing embodiments of the invention. and of note is the detail AREA "A".

FIG. 3—is a top view of a foot of a vacuum cleaner employing embodiments of the invention. and of note is the detail AREA "A.

Area "A" may be on a side, the front or both as in a "corner configuration". Thus, n some preferred embodiments the invention is to be structurally oriented to be at a "corner", where a corner is defined as being both front facing and side facing simultaneously. A corner is defined as both front and side corner definition in context of a round bot. In some alternate embodiments this orientation and thus opening may be configured where one or both front and side openings are structurally configured where one or both openings are in front of the brushroll as in many of the figures. While the opening may be pie shaped, round, square etc. this unique corner configuration can be also regarded as having a generally 90 degree intake range with regard to the cleaners motion or direction of travel. So that when a cleaner, a user operated vacuum or vacuum robot, is traversing generally forward in a generally straight line, there is an opening that is both on the front face and concurrently/simultaneously, generally 90 degrees away on a side face.

This configuration uniquely allows the vacuum to simultaneously get debris along edges and along baseboards and the like while simultaneously not causing "snowplowing" of the debris.

FIG. 27-29 with emphasis on FIG. 29 shows a unique way in which both front and side and thus generally corner can be co-joined and converge at an angle proving both front and side cleaning with an entry in front of the main brushroll. This has the unique added structural advantage of gathering debris from a front and side/edge with the added power-gathering and guiding to the vacuum inlet that the brushroll enables.

Figure 4:
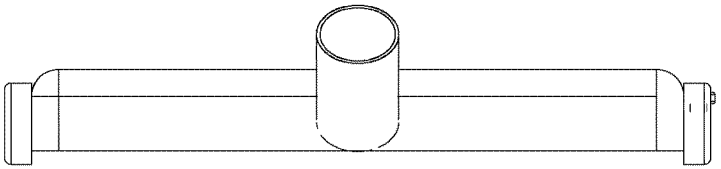
FIG. 4—is a front view of FIG. 3.

FIG. 4—is a front view of FIG. 3.

Figure 5:
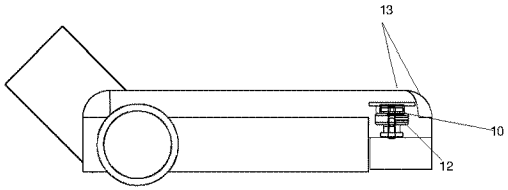
FIG. 5—is a side view of FIGS. 3 and four.

FIG. 5—is a side view of FIGS. 3 and four.

Figure 6:
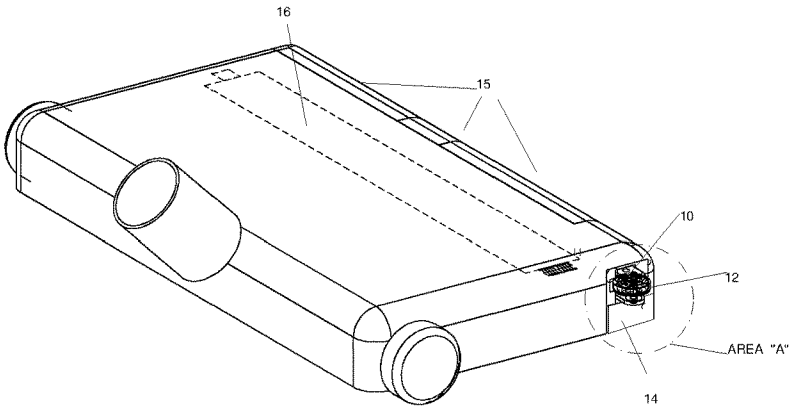
FIG. 6—is a trimetric view, and of note is the detail AREA "A".

FIG. 6—is a trimetric view, and of note is the detail AREA "A".

Figure 7B:
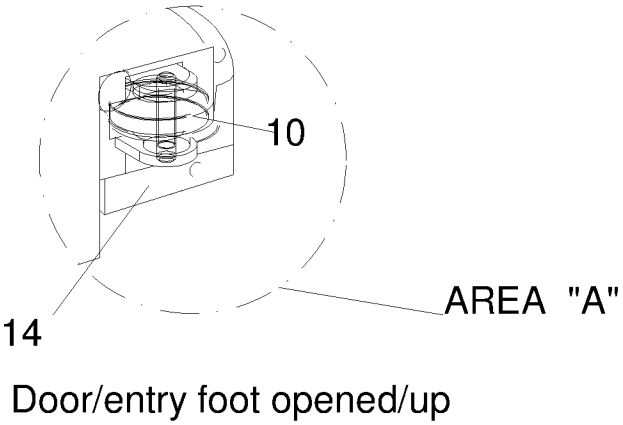
Figure 7A:
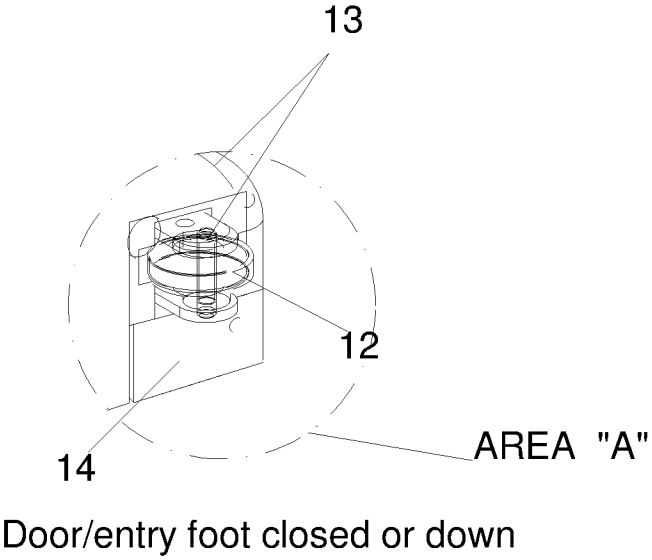
FIGS. 7*a*—and 7*b* are trimetric views of the detail be AREA "A". "showing how in FIGS. 3 through six show that an area on the side or front or a corner may be "raisable" or "doored" FIG. 7*a*—depicts the door in a lowered/closed position and the wheel/actuator in a first position and 7*b* depicts the door in a raised/open position and the wheel/actuator in a second position.

FIGS. 7*a*—and 7*b* are trimetric views of the detail be AREA "A". "showing how in FIGS. 3 and six show that an area on the side or front or a corner may be "raisable" or "doored" FIG. 7*a*—depicts the door in a lowered/closed position and the wheel/actuator in a first position and 7*b* depicts the door in a raised/open position and the wheel/actuator in a second position.

Referring to FIGS. 3 through 7B, it can be seen in these embodiments that there is a wheel, 12, on the corner of the vacuum foot 8. This wheel may be coupled to a switch (lever arm) which then can electro-mechanically raise or swing or slide the door or movable/openable breach 14 from a relatively closed first position, to a relatively open second position. This can be seen readily by contrasting FIGS. 7*a* and 7*b*. As such, where as in traditional configurations there is just a small bleed area, (refer to attachments A), which is always sacrificing suction from the brushroll area, and is limited in size of debris that can be picked up; an active, dynamic and adaptable structure has been created to actively open up a relatively large pathway to the vacuum only when needed.

Figure 9:
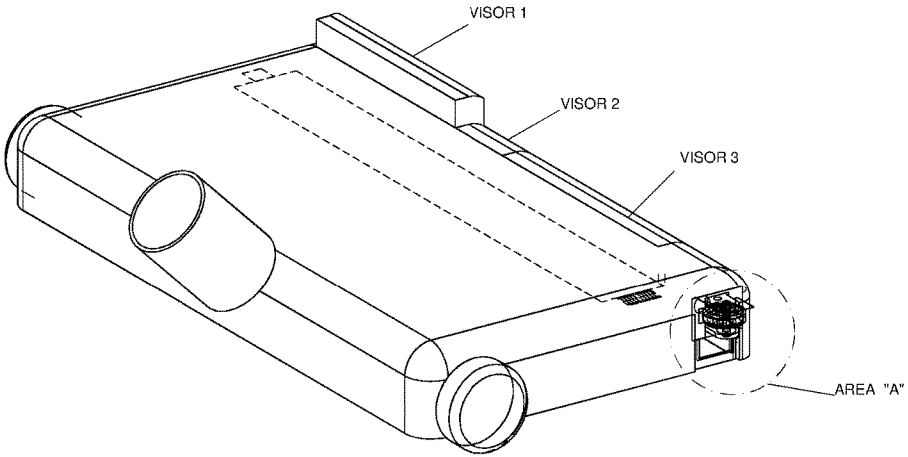
FIG. 9—is another trimetric view of the invention showing that discrete areas in the front may be "raisable" or "doored".
Figure 10:
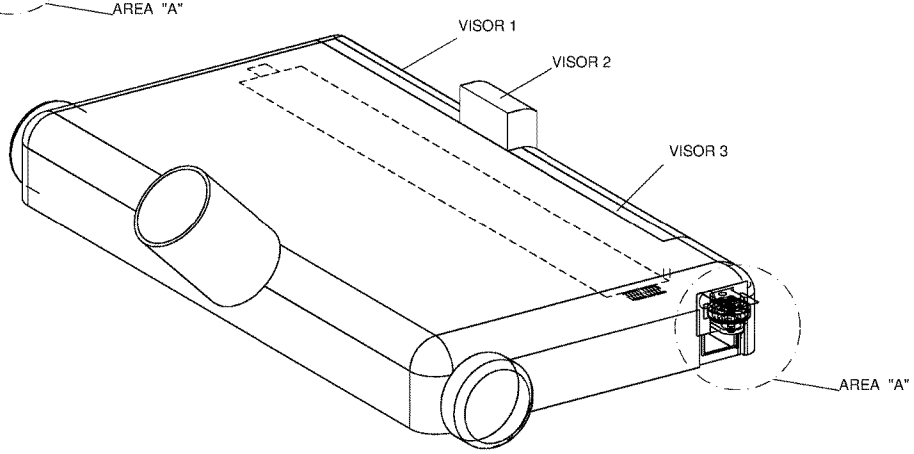
FIG. 10—is another trimetric view of the invention further showing that discrete areas in the front may be "raisable" or "doored".
Figure 8:
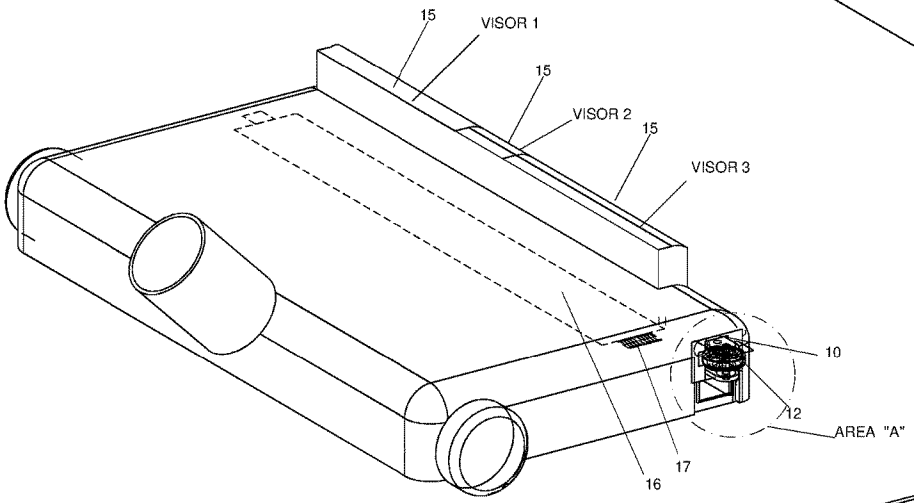
FIG. 8—is another trimetric view of the invention showing that areas in the front and/or corner may be "raisable" or "doored".

Now referring to FIGS. 8 through 10. These refer to another area that can be adaptable to dynamically open and close as the situation dictates. In this disclosure some of these areas are referred to as a visor. In this disclosure a "visor" or portion thereof is simply defined as a door, or movable wall disposed in front of a brushroll. Having a front wall, or visor in front of a brush-roll that comes fairly close to the ground is a necessity and concession in vacuums. This is due to the fact that there is a need to preserve as much vacuum directed towards the floor as possible whether or not there is not there is a brushroll involved. The problem is further exacerbated when there is a brushroll as raising the front wall/visor not only allows "suction air" to escape, but also allows the brushroll to create forward and sideward air currents that actually can blow much debris and hair etc. away from the vacuum head.

FIG. 8—is another trimetric view of the invention showing that areas in the front may be "raisable" or "doored".

FIG. 9—is another trimetric view of the invention showing that discrete areas in the front may be "raisable" or "doored".

FIG. 10—is another trimetric view of the invention further showing that discrete areas in the front may be "raisable" or "doored".

It should be appreciated how a visor may be lifted to be able for a brush roll to get right up to a wall or other object and be able to grab and pull debris as well as lifted whole or in part to allow larger debris to pass under the visor or front wall of a vacuum than is normally possible.

FIGS. 8-10 demonstrate how discrete sections of the front visor, as well as any periphery areas of a vacuum cleaner may be selectively raised in part or in whole. Additionally they may be selectively raised in varying increments, i.e. not fully raised, only enough to allow the debris in.

As stated a reason that a "visor" section needs to be low is to preserve suction and also an exposed brushroll, even partially, can produce a blowing action, actually blowing debris away from the vacuum or sweeper.

However, by raising the visor, or a portion of therewith, a brush-roll may be able to reach with its bristles/flaps debris against other items such as baseboards or furniture may be effected/accomplished.

Referring to all the drawings:

A door or wall or wall part, or visor may be swung (pivoted) sideways or upwards or downwards, inwards or slid (slide) sideways or up/down open, or raised or lowered generally vertically. These actions may be initiated mechanically via input sensor 10, or electrically via sensor switch 7/13, and the resultant actions/mechanisms may be powered by external forces such as the force derived from depressing the input sensor/actuator 10 or electromechanically following initiation.

And so as a vacuum is used (guided by a human user or independently robotic) a door, or visor is selectively activated via a sensor. As depicted in some embodiments, a wheel may be used on the end of the sensor/switch to roll along the baseboards or furniture/obstacles etc. and the door/breach channel/visor may be activated/actuated or may be electro-mechanically activated/actuated via a sensor. And so Push actuators/Mechanical actuator input(s) 13, may also be present on the front or alternate sides/faces of the vacuum so that when they touch a wall, furniture leg or item or piece of debris, the wall/visor/channel/breach is opened etc. to allow the debris free passage. Switches may also be present on the front or alternate sides/faces of the vacuum so that when they touch a wall, furniture leg or item or piece of debris, the wall/visor/channel/breach, is opened etc. to allow the debris free passage.

In other embodiments relatively blunt push-rod structure, and in yet other embodiments a collapsible skirt like structure may be employed to prevent the actuation mechanism from snagging on sharp corners etc.

FIGS. 11-18 are views of various embodiments of the mechanical subassembly area of detail AREA "A" concerning the opening door/channel aperture aspect/embodiments. Referring to FIGS. 11 through 14. In these figures we can see a close up of "Area A". We can see that wheel 12, is connected to mechanical actuator input 10/13. Wheel 12 is not a necessity, but does help as the unit is pushed up against walls/items. As mechanical actuator input is pushed inward, (to the left in the top in front view) wedge lugs 18 which are part of mechanical actuator input 10/13 drive door or movable wall 14, vertically by way of wedge grooves in door on movable block 14 on slide(s). There is a spring 20, to aid in the return of mechanical actuator input 10/13 and the return of door or movable block/blocking element 14 to its first position.

Now Referring to FIGS. 15 through 18 and alternative mechanism will be described.

FIGS. 15-18 show an embodiment that employs pivots. In this embodiment the displacement of the wheel or actuator input 10/13 is multiplied via link 21 so that the door is opened, or the blocking element is raised at a faster ratio.

A block/blocking element(s) or door may be swung sideways or upwards or downwards or slid open, or raised generally vertically. Another structure anticipated is where the mechanical actuator input has a generally horizontal gear rack structure, that interfaces with a spur gear mounted to a non-movable part of the housing, that further interfaces with generally vertical rack that is part of the door or movable block/blocking element(s)/visor. Thus when the actuator is depressed the door or movable block/blocking element(s)/visor moves generally vertically on slide(s). A similar mechanism could swing or slide a door/wall/visor open as well.

Thus a plurality of mechanisms for achieving the sliding, swinging, or raising of a door or moving block/blocking element(s) to an entryway enabling the passage of air and debris into the main vacuum are anticipated from inclined planes to linkages and gears and racks.

While the previous embodiments related to a door being activated or opened, the next set of embodiments contemplate, anticipate and disclose new structures for agitating or sweeping, and directing debris from problem areas. All of these embodiments may be used alone or in conjunction/concert with one another.

Referring to FIGS. 19 through 26

FIG. 19 is a top view of the embodiments of FIGS. 19 to 26 showing the friction wheel on the device.

FIG. 20 is a top view of the embodiments of FIGS. 19 to 26 showing the friction wheel off the device.

FIG. 21 is a front view of the embodiments of FIGS. 19 to 26 showing the friction wheel on the device.

FIG. 22 is a front view of the embodiments of FIGS. 19 to 26 showing the friction wheel off the device.

FIG. 23 is a trimetric view of the embodiments of FIGS. 19 to 26 showing the friction wheel on the device.

FIG. 20 is a trimetric view of the embodiments of FIGS. 19 to 26 showing the friction wheel off the device.

FIG. 25 is a side view of the embodiments of FIGS. 19 to 26 showing the friction wheel on the device.

FIG. 26 is a side view of the embodiments of FIGS. 19 to 26 showing the friction wheel off the device.

And so FIGS. 19-26 are views of various embodiments of the mechanical subassembly area which could also be represented by detail AREA "A" concerning the mechanical powering of brushes. Referring to FIGS. 19-26:

A wheel may be used to roll along the baseboards or furniture/obstacles etc. This wheel may, in some embodiments also carry a brush directly, or in geared, pawled/ratcheting relationship. In this way the brush may agitate and gather/direct debris from edges and corners etc. into a more advantageous area for the vacuum/sweeper to further gather/collect. A brush carried by the wheel directly would rotate at the same rate as the wheel. It may or may not be pawled/ratcheted. In geared applications the brush may rotate at a rate different than the rolling speed of the wheel. so that it only rotates in a single direction. In other embodiments a relatively blunt push-rod structure, and in yet other embodiments a collapsible skirt like structure may be employed to prevent the actuation mechanism from snagging on sharp corners etc. Referring specifically to FIGS. 19 and 20. FIG. 19 is a top view of the subassembly that can be used in a plurality of vacuum end-effectors such as feet, floor wands and the like as has already been described. FIG. 20 shows the wheel 12 removed as well as covers on top of spur gear driving brushes 26 for clarity. Operation is as such, wheel 12 is free to spin on central shaft 24. Wheel 12 carries with it pawl 22, or an equivalent overrunning clutch, so that as it runs along the wall or baseboard, it rotates clockwise it drives ratchet and large spur gear assembly 23 clockwise which then drives spur gear driving brushes 26 counter clockwise. Yet when it runs in the opposite direction the brushes do not spin due to the overrunning one-way clutch. Another gear may be inserted between the Ratchet and Large spur gear assembly 23 and the Spur Gear driving brushes 26 to alter the rotation of one or both of the Spur Gear driving brushes 26.

As stated all the embodiments devices and structures of all the figures. may used alone on a device or structurally be combined in a stacked relationship, side by side relationship or distal to each other on the same device.

Referring to FIGS. 30 through 33:

Inline with previous embodiments, FIGS. 30 through 33 are substantially like the close up "Area A" of FIGS. 3-10, though as in all other embodiments, the disclosed structure(s) could be disposed on any face or corner of a suction end of a vacuum generating device.

FIG. 30 is a top view of the embodiments of FIGS. 31 to 33 showing an electrical solenoid actuator structure with a spring return. A servo or other electromechanical actuator is also anticipated.

FIG. 31 is a front view of the embodiments of FIGS. 30 to 33.

FIG. 32 is a side view of the embodiments of FIGS. 31 to 33.

FIG. 33 is a trimetric view of the embodiments of FIGS. 30 to 33.

And so in these embodiments when wheel 12 comes in contact with a wall, chair leg or the like, microswitch/switch 7 and/or 13 is tripped into a closed or open state, thereby activating solenoid and/or servo 18 structure to raise or swing/slide a door/block/blocking element(s) 14 to open and/or raise creating or enlarging a pathway to the main vacuum while the microswitch/switch is activated. When the microswitch returns to its first state, the door/block/blocking element(s) closes/and/reduces the aperture to its first state. In the depicted illustrations the spring of the solenoid aids in return. Another sensor such as a non contact proximity sensor- or vision sensor may supplant or augment the micro switch to sense middle of the room debris to be gathered, as well as learned, or input mapping of rooms, and any faces/visors etc. may equally and interchangeably be actuated to effect greater cleaning efficacy. These sensors may be coupled to more advanced processing units/computers/micro controllers/or internet enabled processing/storage of data for advanced discernment and learning.

In other embodiments, an optical or proximity sensor which may be interfaced with a controller/micro-controller or other computer for more granular analytical discerning control may be used. Sensor(s) may include an electrical momentary or latching switch. And so sensors may vary from simple switches to known optical sensors, proximity sensors, ultrasonic distance sensors and the like. And so with these non-tactile proximity-sensors, a vacuum may "see" or "sense" and object to be cleaned close to (a chair leg, a wall etc.) or "see" or "sense" debris that needs an additional entryway/orifice to be collected/picked up. Additionally, a robotic vacuum may "learn" where to raise a door block/blocking element(s), visor or the like based on maps it or a user has created for it to follow.

The sensor may be an electrical switch linked to a motor or an electro-mechanical linkage. Electro-Mechanical linkages that are anticipated include motors, servomotors, as well as solenoids piezo-actuators/motors and the like.

I claim:

1. A device to be used with a suction generating vacuum comprising:

a. a box structure to traverse upon a ground surface to be cleaned, where said box structure is further defined by at least a first peripheral wall and a second peripheral wall, where said first peripheral wall is further characterized as a front wall, in top plan view of said box structure, and said second peripheral wall is further characterized as a side wall, in top plan view of said box structure, b. said box structure further including a brushroll configured to be interdisposed between said ground surface and said suction generating vacuum, c. a breach in said first peripheral and said second peripheral walls of said box structure, d. where said breach is disposed generally on a corner of said box structure as a corner breach, and where said corner breach is further characterized as a generally 90 degree breach in top plan view, between said first and said second peripheral walls, e. a door for opening and closing said breach; said door having a first position wherein said breach is closed, f. a sensor, g. and an actuator associated with said door, where when said sensor comes in contact with an object, said door is opened, comprising a second position, where in said second position said door in its entirety is confined to an interior area defined by said first and said second peripheral walls, to allow air and debris to enter said breach and flow towards said suction generating vacuum, where the brushroll is configured to be disposed between said breach and said suction generating vacuum.

2. The structure of claim 1 where said box structure is round.

3. The structure of claim 1 where said box structure is "D" shaped.

4. The structure of claim of 1 where said box structure is rectilinear shaped.

5. The structure of claim of 1 where said door is further defined as a block structure for blocking said breach when said door is in said first position.

6. The structure of claim 1 where said door pivots inward, into said box structure.

7. The structure of claim 1 where said door slides generally horizontally.

8. The structure of claim of 1 where said sensor and said actuator are electrical in nature.

9. The structure of claim of 1 where said sensor is a tactile switch.

10. The structure of claim of 1 where said sensor is an optical sensor.

11. A device to be used with a suction generating vacuum comprising:

a. a box structure to traverse upon a ground surface to be cleaned, where said box structure is further defined by at least a first peripheral wall and a second peripheral wall, where said first peripheral wall is further characterized as a front wall, in top plan view of said box structure, and said second peripheral wall is further characterized as a side wall, in top plan view of said box structure, b. said box structure further including a brushroll configured to be interdisposed between said ground surface and said suction generating vacuum, c. a breach in said first peripheral and said second peripheral walls of said box structure, d. where said breach is disposed generally on a corner of said box structure as a corner breach, and where said corner breach is further characterized as a generally 90 degree breach in top plan view, between said first and said second peripheral walls, e. a door for opening and closing said breach; said door having a first position wherein said breach is closed, f. a sensor, g. and an actuator associated with said door, where when said sensor comes in contact with an object, said door is opened, comprising a second position, where in said second position said door in its entirety is confined to an interior area defined by said first and said second peripheral walls, to allow air and debris to enter said breach and flow towards said suction generating vacuum, where said door moves generally vertically.

12. The structure of claim 11 where said box structure is round.

13. The structure of claim 11 where said box structure is "D" shaped.

14. The structure of claim of 11 where said box structure is rectilinear shaped.

15. The structure of claim of 11 where said door is further defined as a block structure for blocking said breach when said door is in said first position.

16. The structure of claim of 11 where said sensor and said actuator are electrical in nature.

17. The structure of claim of 11 where said sensor is a tactile switch.

18. The structure of claim of 11 where said sensor is an optical sensor.

* * * * *